United States Patent [19]

Adoul et al.

[11] 4,061,878

[45] Dec. 6, 1977

[54] METHOD AND APPARATUS FOR SPEECH DETECTION OF PCM MULTIPLEXED VOICE CHANNELS

[75] Inventors: Jean-Pierre Adoul, Sherbrooke; Fouad Daaboul, Ottawa, both of Canada

[73] Assignee: Universite de Sherbrooke, Canada

[21] Appl. No.: 684,849

[22] Filed: May 10, 1976

[51] Int. Cl.[2] ..... G10L 1/04

[52] U.S. Cl. ..... 179/1 SC; 179/1 VC; 179/15 AS

[58] Field of Search ..... 179/15 AS, 1 P, 1 SA, 179/1 SB, 1 SC, 1 VC

[56] References Cited

U.S. PATENT DOCUMENTS

| | | | |
|---|---|---|---|
| 3,878,337 | 4/1975 | Fariello | 179/15 AS |
| 3,985,956 | 10/1976 | Monti | 179/15 AS |

*Primary Examiner*—David L. Stewart

*Attorney, Agent, or Firm*—Cushman, Darby & Cushman

[57] ABSTRACT

The disclosure herein describes a method and a system for speech detection on PCM multiplexed voice channels; for each channel, a decision is reached every M samples regarding the channel activity; in addition, the nature of speech is detected as: voiced (compact or non-compact) or unvoiced (fricative or non-fricative) when the channel is active; pure silence, white noise or echo when the channel is inactive. The decision is based on the joint value of the amplitude, zero crossing of the signal and zero crossing of the signal derivative.

12 Claims, 2 Drawing Figures

METHOD AND APPARATUS FOR SPEECH DETECTION OF PCM MULTIPLEXED VOICE CHANNELS

FIELD OF THE INVENTION

The present invention relates generally to PCM (Pulse Code Modulation) telecommunications and, more particularly, to speech detection for use in a Time Assignment Speech Interpelation system in which all the signals are expressed in PCM coded form and on time-division basis; such system is known in the art as a PCM-TASI system.

BACKGROUND OF THE INVENTION

TASI systems are well-known and consist basically in increasing the number of signal sources that can be switched over a fixed number of transmission lines by connecting a talker and a listener only when the talker is actually speaking. One example of such a system is described in U.S. Pat. No. 3,030,447 issued Apr. 17, 1962 to Saal.

Most conventional detectors operate on the analog (non-digital) vocal signal and consist in computing the mean power value of the signal and in comparing this value with a pre-determined decision threshold. More recent systems consist in periodically sampling the amplitude of voice-frequency signals and in translating these amplitude values into digital form (see, for example, U.S. Pat. No. 3,712,959 granted Jan. 23, 1973 to Fariello and U.S. Pat. No. 3,832,491 granted Aug. 27, 1974 to Sciulli). However, the decision reached concerning the status of a voice channel is based only on the amplitude of the vocal signal and a distinction is made only between noise and silence.

In present detectors, there is a certain delay before the beginning of the identification of speech so as to prevent undesired pulse noises which could cause the unwanted activation of a transmission channel. This delay is required in order to ensure that the talker has really began to speak and is an inverse function of the signal amplitude. This solution, while avoiding false activation, reduces the intelligibility of the message since there is a chopping of the consonants of low amplitude which, however, contain very useful information. Indeed, the differences between the sounds "ta" and "da" or "pa" and "ba" are condensed in the first milliseconds. Furthermore, in presently known detectors, since consonants include a lot of information and since they are of low amplitude, there is a tendency to consider as speech all signals having a relatively low amplitude. This results in considering as speech: white noises of various origins which are inherent to all transmission channels; and echoes, i.e., vowels of high amplitude which the other talker transmits and which, by interference, are present in the channel under consideration. These echoes are evidently reduced but have sufficient amplitude to cause a reactivation.

OBJECTS OF THE INVENTION

An object of the present invention is to provide a speech detection system that instantly recognizes the presence or absence of speech without being affected by random noises.

It is further object of the present invention to provide a speech detection system whereby, when speech is detected, the actual nature of speech may be known.

It is still a further object of this invention to provide a speech detection system whereby, when no speech is present on a channel, the type of silence or noise may be known.

The present invention is concerned with a speech system which analyses in real time the digital vocal signal and which detects the presence or absence of speech. This system enables to control a group of telephone channels based on silences during conversations. The present system differs from prior systems by its capability of discriminating speech from what is not speech rather than discrimating noise from silence. The present speech detection system enables, at all times, information on the nature of the speech: voiced compact, voiced non-compact, and unvoiced. Then, the system enables to distinguish instantly the presence of short consonants thereby ensuring a greater intelligibility to the telephone transmission.

STATEMENT OF THE INVENTION

The present invention relates to a method of speech detection in a PCM multiplexed voice-channel system which comprises: processing a predetermined batch of consecutive PCM samples; sequentially computing a series of parameters during processing of the predetermined batch of consecutive PCM samples, the parameters relating to: the amplitude, zero crossing, zero crossing of the derivative of the vocal signal; and determining the status of each channel from information received as a result of the computing of the parameters over the batch.

Whereas a certain delay is required in presently known detectors to avoid unwanted noises of short duration, such delay is no longer needed in the present system since the present system is capable of recognizing these voices.

Furthermore, white noises are now detected independently of their amplitude; this is based on a characteristic which distinguishes the white noise from other spoken sounds.

With the present invention, the voiced and unvoiced signals are treated separately; this provides an immunity against echos and the unvoiced signals are not affected by this immunity. Hence, a voiced signal of insufficient amplitude to be a legitimate voiced signal will immediately be identified as an echo; on the other hand, the system will remain extremely sensitive to unvoiced signals (consonants) even of lower amplitude than that of an echo.

BRIEF DESCRIPTION OF THE DRAWINGS

A preferred embodiment will now be described with reference to the accompanying drawings, in which.

DESCRIPTION OF A PREFERRED EMBODIMENT

The voice speech detector of the subject invention operates on PCM samples. Conventionally, the analog voice information is applied to a PCM device which performs a sampling, typically, at a 8 KHz rate; each sample is subsequently converted into a 8 bit binary code. In accordance with the specific embodiment described herein, the 8 bit samples are received in subassembly I in FIG. 1. The logarithm of the amplitude of each sample is coded by an integer taken between −127 and +127 (with a double zero: −0 and +0 for symmetry purpose).

The detector of the present invention operates on N multiplexed voice channels. For channel *n*, the detector compputes four parameters from a batch of *M* consecutive samples. Thus, as far as channel *n* is concerned, a new set of four parameters is available every *M* samples. For a particular channel, the parameters are the four positive integers defined as:

*a:* the sum of the absolute values of the *M* samples:

$$a = \sum_{i=1}^{M} |X_i| \quad \text{where } X_i \text{ is the integer corresponding to the } i^{th} \text{ sample of the waveform;}$$

*zo:* the number of zero crossings of the waveform is the number of sign changes between consecutive samples;

*zl:* considering the sequence of the *M* differences between consecutive samples (i.e. $\Delta_1 = X_i - X_i$; for $i = 1, 2, 3 \ldots M$), *zl* represents the number of sign changes among these *M* differences; in the sequel $\Delta_1$ will be referred to as the signal derivative;

*d:* it is *zl* minus *zo.*

The status of channel *n* is decided on the sole basis of the four integers along with its previous status.

For each channel, there are two operating modes. First, there is the computation mode which consists in computing the values of *a, zo, zl* and *d* which is done sequentially, as soon as the PCM samples arrive at the input of the speech detector. Secondly, there is the decision mode which consists in providing a decision at the end of a predetermined batch of *M* samples. However, in order to carry out these operations, the parameters *a, zo, zl* and *d* are truncated to become, respectively, *A, Zo, Zl* and *D.* The decision is then obtained by means of three memories. In the embodiment described, the same ROM memory of 256 binary inputs and 8 binary outputs is consecutively used three times; this memory is divided into three fields of 128, 64 and 64 binary inputs, respectively.

Figure 2:
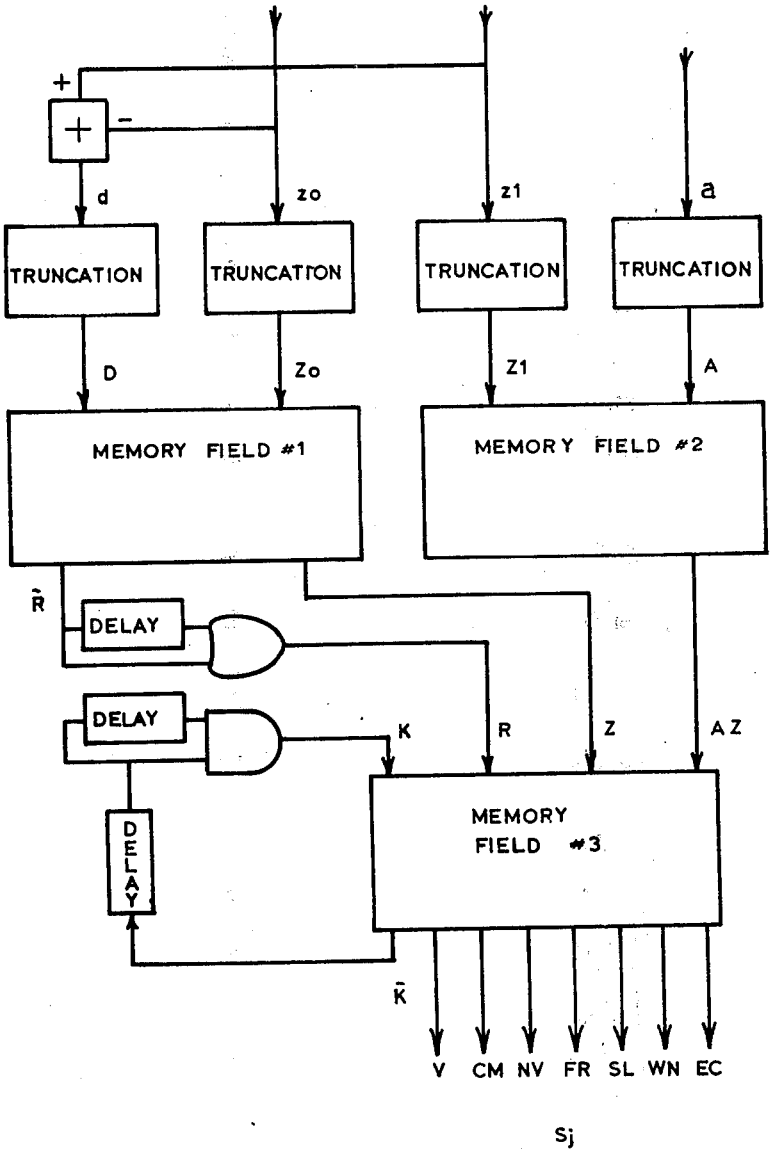
FIG. 2 is a schematic representation of the basic principle of the decision stage of the present invention.

FIG. 2 illustrates a schematic representation of the truncation of *a, zo, zl* and *d* into *A, Zo, Zl* and *D.*

$A = 0, 1, 2, 3, 4, 5, 6, 7$; it is the binary number corresponding to the three highest bits of the binary number (in 11 bits for $M = 48$) corresponding to $Ma + \alpha_1$ wherein $\alpha_1$ is a constant which enables to optimize the information contained in *A.* For $M = 48$, for example, $\alpha_1 = -20$; for another value of *M,* another value of $\alpha_1$ must be determined in order to maintain as close as possible the equivalence between *a* and *A* given in the following Table 1*a.*

TABLE 1a

| a | A |
|---|---|
| $a \leqq 4$ | 0 |
| $5 \leq a < 12$ | 1 |
| $12 \leqq a < 28$ | 2,3,4 |
| $28 \leqq a$ | 5,6,7 |

This value $\alpha_1$ may be made adjustable with the mean level of a talker based upon a few seconds. This results in directly rendering the detector adaptable in amplitude which may represent an adavantage in certain applications.

$Zo = 0, 1, 2, 3, \ldots 15$ is the binary number corresponding to the four highest bits of the binary number (in 5 bits for $M = 48$) corresponding to $zo + \alpha_2$. For $M = 48$, $\alpha_2$ is equal to $= +2$; for another value of *M,* another value of $\alpha_2$ must be determined to satisfy the equivalence of Table 1*b.*

TABLE 1b

| zo | Zo |
|---|---|
| $zo < \frac{M}{2.6}$ | 0 |
| $zo > \frac{M}{2.6}$ | 1 |

$Zl = 0, 1, 2, 3, \ldots 7$ is the binary number corresponding to the three highest bits of the binary number (in 6 bits for $M = 48$) corresponding to $zl + \alpha_3$. For $M = 48$, $\alpha_3$ is equal to $+6$; for another value of *M,* another value of $\alpha_3$ must be determined to satisfy the Table 1*c.*

TABLE 1c

| zl | Zl |
|---|---|
| $zl < \frac{M}{2.6}$ | 0,1,2 |
| $\frac{M}{2.6} \leqq zl < \frac{M}{1.8}$ | 3,4 |
| $\frac{M}{1.8} \geqq zl$ | 5,6,7 |

$D = 0, 1, 2, \ldots 7$ is the binary number corresponding to the three highest bits of the binary number (in 4 bits for $M = 48$) corresponding to $zl - zo$.

The four new integers are processed two by two.

The memory field #1, which receives inputs *D* and *Zo,* provides two output binary parameters $\tilde{R} = 0,1$ and $Z = 0,1$ as in Table 1*d.*

TABLE 1d

| zo, zl or d | $\tilde{R}$ |
|---|---|
| $1.18 \leqq \frac{zl}{zo} \leqq 1.42$ | 0 |
| If not | 1 |

It should be noted that $\tilde{R}$ is a function of the ratio *zl/zo;* this value is easy obtainable from the parameters *d* and *zo* which are sufficiently approximated by *D* and *Zo.* In essence, $\tilde{R}$ identifies the presence of white voice.

The memory field #2, which receives inputs *Zl* and *A,* provides an output binary number $AZ = 0,1 \ldots 6$ of 3 bits in accordance with Table 2.

TABLE 2

| | Zl | | | | | | | |
|---|---|---|---|---|---|---|---|---|
| A | 0 | 1 | 2 | 3 | 4 | 5 | 6 | 7 |
| 0 | 0 | 0 | 0 | 0 | 0 | 0 | 0 | 0 |
| 1 | 1 | 1 | 1 | 4 | 4 | 6 | 6 | 6 |
| 2 | 2 | 2 | 2 | 5 | 5 | 6 | 6 | 6 |
| 3 | 2 | 2 | 2 | 5 | 5 | 6 | 6 | 6 |
| 4 | 2 | 2 | 2 | 5 | 5 | 6 | 6 | 6 |
| 5 | 2 | 2 | 2 | 3 | 3 | 6 | 6 | 6 |
| 6 | 2 | 2 | 2 | 3 | 3 | 6 | 6 | 6 |
| 7 | 2 | 2 | 2 | 3 | 3 | 6 | 6 | 6 |

AZ = f(A,Z1)

The memory field #3 receives inputs, *K, R, Z* and *AZ* (*K* and *R* being two binary parameters, the obtention of which will be described hereinbelow); it provides, first, an intermediate parameter $\tilde{K} = 0,1$ the value of which with respect to the inputs is given in Table 3*a:*

TABLE 3a

| | | | AZ | | | | | | |
|---|---|---|---|---|---|---|---|---|---|
| Zo | R | K | 0 | 1 | 2 | 3 | 4 | 5 | 6 |
| 0 | 0 | 0 | 1 | 1 | 0 | 0 | 0 | 0 | 0 |
| 0 | 0 | 1 | 1 | 1 | 0 | 0 | 0 | 0 | 0 |
| 0 | 1 | 0 | 1 | 1 | 0 | 0 | 0 | 0 | 1 |
| 0 | 1 | 1 | 1 | 1 | 0 | 0 | 0 | 0 | 1 |

TABLE 3a-continued

| | | | AZ | | | | | | |
|---|---|---|---|---|---|---|---|---|---|
| Zo | R | K | 0 | 1 | 2 | 3 | 4 | 5 | 6 |
| 1 | 0 | 0 | 1 | 0 | 0 | 0 | 0 | 0 | 0 |
| 1 | 0 | 1 | 1 | 0 | 0 | 0 | 0 | 0 | 0 |
| 1 | 1 | 0 | 1 | 1 | 1 | 1 | 1 | 1 | 1 |
| 1 | 1 | 1 | 1 | 1 | 1 | 1 | 1 | 1 | 1 |

K = f(Zo,R,K,AZ)

TABLE 3b

| | | | AZ | | | | | | |
|---|---|---|---|---|---|---|---|---|---|
| Zo | R | K | 0 | 1 | 2 | 3 | 4 | 5 | 6 |
| 0 | 0 | 0 | 5 | 1 | 1 | 2 | 3 | 3 | 4 |
| 0 | 0 | 1 | 5 | 7 | 1 | 2 | 6 | 3 | 4 |
| 0 | 1 | 0 | 5 | 1 | 1 | 2 | 3 | 3 | 3 |
| 0 | 1 | 1 | 5 | 7 | 1 | 2 | 6 | 3 | 6 |
| 1 | 0 | 0 | 5 | 4 | 4 | 4 | 4 | 4 | 4 |
| 1 | 0 | 1 | 5 | 4 | 4 | 4 | 4 | 4 | 4 |
| 1 | 1 | 0 | 5 | 3 | 3 | 3 | 3 | 3 | 3 |
| 1 | 1 | 1 | 5 | 6 | 6 | 6 | 6 | 6 | 6 |

S = f(Zo,R,K,AZ)

On the other hand, memory field #3 provides the status information $S = 1, 2, \ldots 7$, the value of which with respect to the inputs is given in Table 3*b*. This status may be conveniently described by seven binary variables referenced: V, CM, NV, FR, SL, WN and EC, which take the values of 0 or 1 according to Table 4*a*.

Table 4a

| STATUS NUMBER | OUTPUT INFORMATION CORRESPONDING TO STATUS | | | | | | | IDENTIFIED WAVEFORM | |
|---|---|---|---|---|---|---|---|---|---|
| S | V | CM | NV | FR | SL | WN | EC | CHANNEL | TYPE OF SPEECH |
| 1 | 1 | 1 | 0 | 0 | 0 | 0 | 0 | active | Voiced compact |
| 2 | 1 | 0 | 0 | 0 | 0 | 0 | 0 | active | Voiced non-compact |
| 3 | 0 | 0 | 1 | 0 | 0 | 0 | 0 | active | Unvoiced, non-fricative |
| 4 | 0 | 0 | 1 | 1 | 0 | 0 | 0 | active | Unvoiced, fricative |
| 5 | 0 | 0 | 0 | 0 | 1 | 0 | 0 | passive | Silence |
| 6 | 0 | 0 | 0 | 0 | 1 | 1 | 0 | passive | White noise |
| 7 | 0 | 0 | 0 | 0 | 1 | 0 | 1 | passive | Echo |

The script $j$ is given to the parameters and to the decisions pertaining to the present batch of $M$ samples and $j-1, j-2$ for the preceding decisions. Therefore, $R$ and $K$ may be defined by the following logic equations: $R_j = \tilde{R}_j$ "or" $\tilde{R}_{j-1}$ and $K_j = \tilde{K}_{j-1}$ "and" $\tilde{K}_{j-2}$ (where "and" and "or" are the operators of the Boolean logic).

The ultimate decision, $S_j^*$, concerning the status of a channel after the analysis of batch $j$ is given at table 4*b*.

TABLE 4b

| | $S_j$ | | | | | | |
|---|---|---|---|---|---|---|---|
| $S_{j-1}$ | 1 | 2 | 3 | 4 | 5 | 6 | 7 |
| 1 | 1 | 1 | 3 | 4 | 5 | 6 | 7 |
| 2 | 2 | 2 | 3 | 4 | 5 | 6 | 7 |
| 3 | 1 | 2 | 3 | 3 | 5 | 6 | 7 |
| 4 | 1 | 2 | 4 | 4 | 5 | 6 | 7 |
| 5 | 1 | 2 | 3 | 4 | 5 | 6 | 7 |
| 6 | 1 | 2 | 3 | 4 | 5 | 6 | 7 |
| 7 | 1 | 2 | 3 | 4 | 5 | 6 | 7 |

$S_j^* = f(S_j, S_{j-1})$ $S_j^*$ is a function of status $S_j$ given by the memory field #3 as well as the status of $S_{j-1}$ which was identified by the same memory for the preceding batch. $S_j^*$ is equal to $S_j$, except in few cases where it is equal to $S_{j-1}$. These exceptions correspond to a minor refinement of the decision concerning the type voiced, compact/non-compact, or unvoiced fricative or non-fricative.

Figure 1:
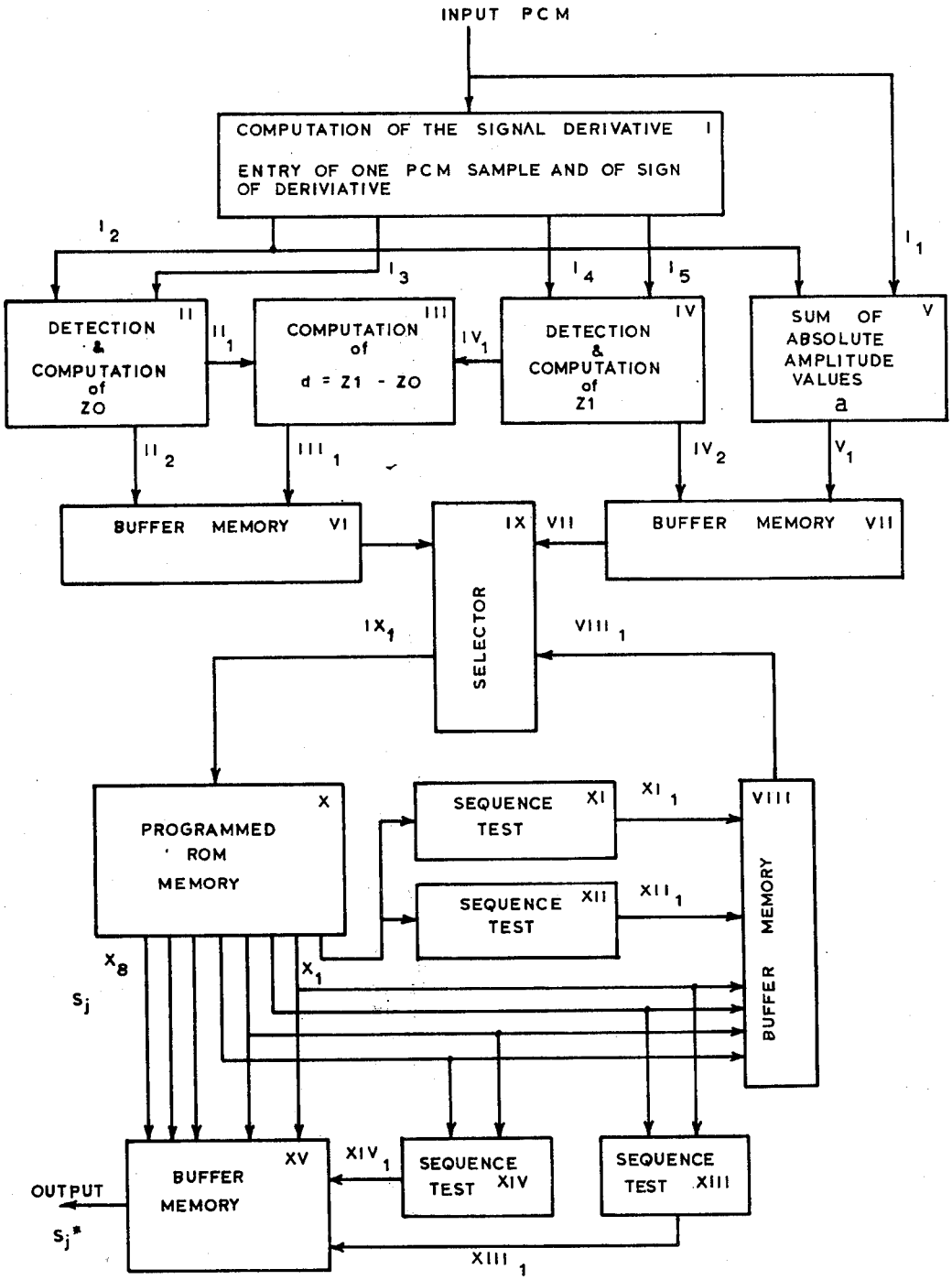
FIG. 1 is a block diagram of the speech detector made in accordance with the present invention.

Referring to FIG. 1, the detector made in accordance with the present invention includes 15 sub-assemblies which are referenced in Roman numerals. The output of a sub-assembly is referred by its Roman numeral, followed by the subscript: 1, 2, 3, . . . .

A description of each sub-assembly and of its function will now be given.

SUB-ASSEMBLY I

This sub-assembly receives the PCM samples of the waveform which constitute the input to the detector and computes sequentially the differences corresponding to the derivative of the signal. The sequential operation of the speech detector allows to keep in the memory of this sub-assembly only one PCM sample per channel and the sign of the derivative. This sub-assembly will include a series of shift registers and a substracting device for effecting the differences.

SUB-ASSEMBLY II

For each channel, this sub-assembly detects the zero crossings of the waveform by comparing the signs of two successive samples and computing the sum (*zo*) of a batch of M samples. This sub-assembly will include a series of shift registers, an adding device for adding the zero crossings and a two-bit comparator for comparing the signs of the signal samples.

SUB-ASSEMBLY III

For each channel, this sub-assembly computes the difference (*d*) between the number of zero crossings (*zo*) of the signal and the number of zero crossings of the derivative (*zl*) for a batch of M samples. This sub-assembly will include shift registers and a three-bit adder.

SUB-ASSEMBLY IV

For each channel, this sub-assembly detects the zero crossings of the derivative of the signal by comparing the signs of two successive samples and computing the sum (*zl*) for a batch of M samples. This sub-assembly will include a series of shift registers, an adder for adding the zero crossings of the signal derivative and a comparator for comparing the signs of the samples of the derivative.

SUB-ASSEMBLY V

For each channel, this sub-assembly takes the absolute value of the amplitude of each sample of the signal and computes the sum (*a*) thereof for a batch of M samples. This sub-assembly will include a series of shift registers, a two-bit adder and a two-input selector to take the absolute value of the PCM sample that enters.

SUB-ASSEMBLY VI

For each successive channel, this sub-assembly effects a quantification or truncation on *zo*, which comes from sub-assembly II and becomes *Zo*, and keeps it in memory with a format of 4 bits. It also effects a quantification on *d* which comes from sub-assembly III and becomes D, and keeps it in memory with a format of 3 bits. It further includes a one bit memory for the addressing of sub-assembly X. This sub-assembly will include a shift register which will serve as a buffer memory between sub-assemblies II and III and sub-assembly X.

SUB-ASSEMBLY VII

For each successive channel, this sub-assembly effects a quantification on *Zl*, coming from sub-assembly IV, which becomes *Zl*, and keeps it in memory with a format of 3 bits. It also effects a quantification on a, coming from the sub-assembly V, which becomes A, and keeps it in memory with a format of three bits. It further includes a two bit memory for the addressing of sub-assembly X. This sub-assembly will include a shift register which serves as a buffer memory between sub-assemblies IV and V and sub-assembly X.

SUB-ASSEMBLY VIII

For each successive channel, it keeps in memory the outputs of sub-assemblies XI and XII and the outputs $X_2$ to $X_5$ of sub-assembly X. If further includes a two bit memory for the addressing of sub-assembly X. This sub-assembly will include a pair of shift registers.

SUB-ASSEMBLY IX

This sub-assembly enables, for each channel, to successively direct the outputs of sub-assemblies VI, VII, VIII to the inputs of sub-assembly X.

SUB-ASSEMBLY X

This sub-assembly consists of a read only memory (ROM) including three fields respectively addressed by sub-assemblies VI, VII, VIII. The parameters $\tilde{R}$ and Z resulting from the memory field #1 are the outputs $X_1$ and $X_2$ which respectively constitute the inputs of sub-assemblies XII and VIII. The memory field #2 gives parameter AZ on outputs $X_3$, $X_4$, $X_5$, thereby completing the input of sub-assembly VIII. The informations with respect to the status V, NV, SL, WN, EC resulting from memory field #3 is available on $X_2$, $X_4$, $X_6$, $X_7$, and $X_8$ and are entered in sub-assembly XV whereas the parameters CM and FR on outputs $X_3$ and $X_5$, respectively, are entered in sub-assemblies XIII and XIV. The parameter K on output $X_1$ constitutes the input of sub-assembly XI.

SUB-ASSEMBLY XI

For each channel, it provides a sequence test on parameter $\tilde{K}$ between two consecutive batches of *M* samples; this sub-assembly will include a pair of shift registers and an "AND" gate.

SUB-ASSEMBLY XII

For each channel, it provides a sequence test for parameter $\tilde{R}$ between two consecutive batches of M samples; this sub-assembly will include a shift register and an "OR" gate.

SUB-ASSEMBLY XIII

For each channel, it provides a sequence test on the results NV and FR between two consecutive batches of M samples. This sub-assembly will include a pair of shift registers and a two input selector.

SUB-ASSEMBLY XIV

For each channel, it provides a sequence test on the results V and CM between two consecutive batches of *M* samples. This sub-assembly will include a pair of shift registers and a two input selector.

SUB-ASSEMBLY XV

For each successive channel, it keeps in memory the results V, CM, NV, FR, SL, WN, EC and makes them available during the time allotted to a channel. It includes a shift register which serves as a buffer memory for the results obtained.

It is to be understood that the above described arrangements are merely illustrative of numerous and varied other arrangements which may form applications of the principles of the invention both in the calculation and in the decision (i.e.: several distinct memories, use of micro processors . . . ). It is evident that these other arrangements may readily be devised by persons skilled in the art without departing from the spirit and scope of the present invention.

What is claimed is:

1. A speech detector for use in a PCM multiplexed voice channel system comprising: means for processing a predetermined batch of consecutive PCM samples; means for sequentially computing a series of parameters during processing of said predetermined batch of consecutive PCM samples, said parameters consisting of a function of the amplitude of the vocal signal, the zero crossing of the voice signal, the zero crossing of the derivative of the vocal signal; and means for determining the status of each channel from information received as a result of the computing of said parameters over said predetermined batch.

2. A speech detector as defined in claim 1, further comprising means for determining the nature of speech detected from said information received as a result of the computing of said parameters over said predetermined batch; said speech being determined as voiced compact, voiced non-compact, unvoiced fricative, unvoiced non-fricative.

3. A speech detector as defined in claim 1, wherein said determining means provide further information on said channel when said status is inactive, said further information pertaining to the presence of white noise, echo or pure silence.

4. A speech detector as defined in claim 2, wherein said parameters include the following four integers:

*a:* the sum of the absolute values of said amplitude;

*zo:* the number of sign changes between consecutive PCM samples;

*zl:* the number of sign changes among the sequence of differences between consecutive PCM samples;

*d:* the difference between *zl* and *zo*.

5. A speech detector as defined in claim 4, further including means for effecting a quantification of the values of *a, zo, zl* and *d*.

6. A speech detector as defined in claim 4, wherein white noise is determined by the value of the ratio *zl/zo* within predetermined limits.

7. A speech detector as defined in claim 6, wherein said determining means include a ROM memory having three fields successively used for each batch of samples.

8. A method of speech detection in a PCM multiplexed voice channel system, comprising: processing a predetermined batch of consecutive PCM samples; sequentially computing a series of parameters during processing of said predetermined batch of consecutive PCM samples, said parameters consisting of a function of the amplitude of the vocal signal, the zero crossing of the vocal signal, the zero crossing of the derivative of the vocal signal; and determining the status of said channel from information received as a result of the computing of said parameters over said predetermined batch.

9. A method as defined in claim 8, further determining the nature of speech detected from said information received as a result of said computing as: voiced compact, voiced non-compact, unvoiced fricative, unvoiced non-fricative.

10. A method as defined in claim 8, further defining the nature of each channel when no speech is detected as: white noise, pure silence, echo.

11. A method as defined in claim 9, defining said parameters into four positive integers as follows:

*a:* the sum of absolute values of said amplitude of said PCM samples;

*zo:* the number of sign changes between consecutive PCM samples;

*zl:* the number of sign changes among the sequence of differences between consecutive PCM samples;

*d:* being equal to $zl-zo$.

12. A method as defined in claim 11, further effecting a quantification of said integers prior to the determining steps.

* * * * *